US011480201B2

(12) United States Patent
Stegmanns

(10) Patent No.: US 11,480,201 B2
(45) Date of Patent: Oct. 25, 2022

(54) ELECTROPNEUMATIC CONTROL SYSTEM AND POSITION CONTROLLER FOR SUCH A SYSTEM

(71) Applicant: Siemens Aktiengesellschaft, Munich (DE)

(72) Inventor: Robert Markus Stegmanns, Ubstadt-Weiher (DE)

(73) Assignee: Siemens Aktiengesellschaft, Munich (DE)

( * ) Notice: Subject to any disclaimer, the term of this patent is extended or adjusted under 35 U.S.C. 154(b) by 138 days.

(21) Appl. No.: 16/347,863

(22) PCT Filed: Nov. 10, 2017

(86) PCT No.: PCT/EP2017/078923
§ 371 (c)(1),
(2) Date: May 7, 2019

(87) PCT Pub. No.: WO2018/087307
PCT Pub. Date: May 17, 2018

(65) Prior Publication Data

US 2019/0285097 A1 Sep. 19, 2019

(30) Foreign Application Priority Data

Nov. 11, 2016 (DE) ..... 102016222153.1

(51) Int. Cl.
*F15B 19/00* (2006.01)
*F15B 13/042* (2006.01)
(Continued)

(52) U.S. Cl.
CPC ..... *F15B 19/002* (2013.01); *F15B 13/042* (2013.01); *F15B 19/005* (2013.01);
(Continued)

(58) Field of Classification Search
CPC .... F15B 19/002; F15B 13/042; F15B 19/005; F15B 5/006; F15B 21/082;
(Continued)

(56) References Cited

U.S. PATENT DOCUMENTS 4,647,004 A * 3/1987 Bihlmaier ..... F15B 11/072 251/28
5,291,190 A * 3/1994 Scarola ..... G21D 3/08 340/3.32
(Continued)

FOREIGN PATENT DOCUMENTS

CN 102080735 * 6/2001 ..... F16K 31/02
CN 204284031 U 4/2015
(Continued)

OTHER PUBLICATIONS

SMC, "Series IP8 Electro-Pneumatic Positioner/Smart Positioner (Lever type/Rotary type)", Mar. 2015, pp. 7-30, downloaded from the internet https://web.archive.org/web/20150306041242/http://ca01.smcworld.com/catalog/BEST-old-en/pdf/ip8000_en.pdf (Year: 2015).*
(Continued)

*Primary Examiner* — Rocio Del Mar Perez-Velez
*Assistant Examiner* — Olvin Lopez Alvarez
(74) *Attorney, Agent, or Firm* — Cozen O'Connor

(57) ABSTRACT

An electropneumatic control system for a pneumatic drive and electropneumatic position controller for the system, wherein a volume flow booster having a bypass valve is downstream of the position controller to increase the air capacity, where the pneumatic drive is run in a new operating mode multiple times at maximum air capacity in a first direction to support an operator in adjusting the bypass valve, and where upon exceeding a specified position, the air capacity is set to zero, an overshoot value of the pneumatic
(Continued)

drive is determined and output for the operator on a display such that by varying adjustment of the bypass valve, the operator can find and set an adjustment of the valve having low overshoot such that with an adjustment found in such a manner, the transition behavior of the control system can be significantly improved without additional effort.

9 Claims, 5 Drawing Sheets

(51) Int. Cl.
*F15B 5/00* (2006.01)
*F15B 21/08* (2006.01)

(52) U.S. Cl.
CPC ..... *F15B 5/006* (2013.01); *F15B 21/082* (2013.01); *F15B 2211/30565* (2013.01); *F15B 2211/40515* (2013.01); *F15B 2211/6336* (2013.01); *F15B 2211/6656* (2013.01); *F15B 2211/8613* (2013.01)

(58) Field of Classification Search
CPC .. F15B 2211/30565; F15B 2211/40515; F15B 2211/6336; F15B 2211/6656; F15B 2211/8613
See application file for complete search history.

(56) References Cited

U.S. PATENT DOCUMENTS 6,192,321 B1 * 2/2001 Grumstrup ..... G05B 21/02 137/1
6,745,084 B2 * 6/2004 Boger ..... F15B 5/006 700/13
7,089,086 B2 * 8/2006 Schoonover ..... G05B 17/02 251/129.01
7,593,802 B2 * 9/2009 Junk ..... G05B 13/024 360/77.04
8,087,638 B2 * 1/2012 Burlage ..... F16K 31/1262 251/122
2004/0182074 A1 9/2004 Steinke et al.
2005/0229775 A1 * 10/2005 Junk ..... F16K 11/04 91/463
2005/0278074 A1 12/2005 Junk et al.
2007/0084201 A1 4/2007 Schulz et al.
2009/0090665 A1 * 4/2009 Nibler ..... F28D 1/053 210/167.11
2012/0061606 A1 3/2012 Lovell et al.
2017/0204885 A1 7/2017 Valentin-Rumpel

FOREIGN PATENT DOCUMENTS

DE 102005049061 3/2007
DE 102016100919 5/2017
EP 1769159 4/2007

OTHER PUBLICATIONS

Saito et al, "YVP110 Advanced Valve Positioner", 2001, pp. 4, downloaded from the internet https://web-material3.yokogawa.com/rd-tr-r00032-007.pdf (Year: 2001).*
Emerson Process Managament, "Fisher Fieldvue™ DVC6200 Digital Valve Controller", May 2013, pp. 148, downloaded from the internet https://data2.manualslib.com/pdf6/122/12164/1216387-fisher/fieldvue_dvc6200.pdf?21526662aaf1f8d2f81aec4b8ad0179f&take=binary (Year: 2013).*
SMC, "Smart Positioner (Lever Type) IP 8001 Series", 2008, pp. 92, downlaoded from the internet https://www.docsity.com/pt/ip8101-op-manual-dig-31900-om002-c/4880447/ (Year: 2008).*
Bela, "Controller Action and Positioner Rules", Oct. 2014, pp. 13 downloaded from https://www.controlglobal.com/articles/2014/controller-action-and-positioner-rules/ (Year: 2014).*
Flowserve, "Valtek Flow Boosters", 1998, pp. 6, downloaded from the internet https://www.helgem.com.tw/Valtek/Electronic%20Literature/Literature/Valtek%20Control%20Products%20Literature/Technical%20Bulletins/Actuators/FlowBoosterTB.pdf (Year: 1998).*
Office Action dated Feb. 26, 2020 issued in Chinese Patent Application No. 201780069710.1, pp. 11.
PCT International Search Report dated Jan. 29, 2018 based on PCT/EP2017/078923 filed Nov. 10, 2017, pp. 4.

* cited by examiner

ELECTROPNEUMATIC CONTROL SYSTEM AND POSITION CONTROLLER FOR SUCH A SYSTEM

CROSS-REFERENCE TO RELATED APPLICATIONS

This is a U.S. national stage of application No. PCT/EP2017/078923 filed Nov. 10, 2017. Priority is claimed on German Application No. 102016222153.1 filed Nov. 11, 2016, the content of which is incorporated herein by reference in its entirety.

BACKGROUND OF THE INVENTION

1. Field of the Invention

The invention relates to an electropneumatic control system for a pneumatic actuator, an electropneumatic position controller for such a control system, a method for operating the electropneumatic control system, a computer program having program code instructions executable by a microcontroller of a position controller for implementing the method, and a computer program product comprising such a computer program.

2. Description of the Related Art

EP 1 769 159 B1 discloses an electropneumatic control system having a position controller that is suitable for controlling the position of an associated final control element, e.g., a valve or damper position, on pneumatic linear or rotary actuators. The position controller is prescribed a setpoint value by a process controller or control system, e.g., via a field bus or via an analog 4 to 20 mA interface, and the position controller then enforces on the actuator a position corresponding to this setpoint value. The pressure in an actuator chamber or, in the case of double-acting actuators, in both actuator chambers is varied until the prescribed position of the final control element is reached. For this purpose, the current position is detected using a position sensor, e.g., a conductive plastic potentiometer, and an actual value signal produced by the position sensor is supplied together with the setpoint value to a microcontroller of the position controller. The microcontroller compares the two signals, establishes a control deviation and calculates the required switching reactions of downstream pneumatic valves taking into account the dynamics of the pneumatic actuator. A valve is located in the supply-air path for increasing the air pressure in the respective chamber, another valve is located in the exhaust-air path and opens if the chamber is to be vented.

As the air flow rate of the valves incorporated in the electropneumatic position controller is limited, large pneumatic actuators often require the installation of a volume booster to achieve a desired positioning speed. For example, in the case of control valves, a maximum closing or opening time is specified that must be maintained by the electropneumatic control system. Such a booster enables the air flow rate to be increased by a multiple, e.g., by a factor of twenty, compared to a simple position controller. The booster is inserted between the position controller and the actuator and, like the position controller, is connected to supply air. A first pneumatic control signal that is generated by the position controller is used to control the booster. In the case of double-acting actuators, two such boosters are installed, one for each chamber.

However, the use of boosters in electropneumatic control system can disadvantageously result in an undesirable behavior, particularly when the position of the actuator changes. To improve the behavior, as described in the previously cited publication EP 1 769 159 B1, a feedback signal is created in the volume booster to detect the operating state thereof and this signal is included in the control loop of the position controller. However, the generation of the feedback signal in the booster and the paths for feeding the signal back to the electropneumatic position controller involve significant additional cost/complexity. This cost/complexity is considered to be necessary even if a so-called bypass valve is used.

SUMMARY OF THE INVENTION

In view of the foregoing, it is an object of the invention to provide an electropneumatic control system for a pneumatic actuator and a method for operating the control system that provide a particularly simple way to adjust a bypass valve for good control system performance. Another object is to provide a suitable electropneumatic position controller for such a control system and a suitable computer program for the position controller.

This and other objects and advantages are achieved in accordance with the invention by an electropneumatic control system, an electropneumatic position controller, a corresponding method for operating the electropneumatic control system, a computer program having program code instructions that can be executed by a microcontroller of a position controller to implement the method, and a computer program product comprising such a computer program, were the electropneumatic position controller is configured to repeatedly move the pneumatic actuator with maximum air flow rate in a first direction in each different setting of the bypass valve until a predefined or predefinable position is reached, to set the air flow rate to zero each time the position is overshot, and to determine an overshoot value of the pneumatic actuator for the respective setting of the bypass valve and output the overshoot value on a display.

The advantage of the invention is that an operating mode for the electropneumatic control system has been created in which an operator is guided to a suitable adjustment of a bypass valve in a particularly simple and reliable manner.

Finding a suitable setting of the bypass valve is particularly important because of the following problems: if the bypass valve on the booster is completely closed, usually even minimal pressure variations of the first pneumatic control signal affect the output of the booster, as the latter delivers pressure variations in an amplified manner to its output, i.e., onto the second pneumatic control signal. This disadvantageously means that a valve provided with a pneumatic actuator is likely to vibrate, because fine control of the actuator position is not possible using small amounts of air in such a setting. Wide opening of the bypass valve results in a slow response of the booster and may likewise cause vibrations because of the associated delay in the position control loop.

Opening of the bypass valve by a certain amount allows the pressure variations on the pneumatic control signals to be attenuated, because minimal variations can now be compensated via the bypass valve. However, finding a bypass valve setting well suited for this purpose has hitherto proved to be comparatively difficult. The position controller had to be caused to move the pneumatic actuator via manual input. With the actuator stopped, an operator had to visually assess the behavior of the pneumatic actuator or rather of the valve operated thereby. If actuator overshoot could be detected, then the bypass valve on the volume booster was opened further. As this procedure only permitted a qualitative assessment of the transient response, the finding of a throttle valve setting with minimal overshoot was rather left to chance.

In contrast, the advantage of the inventive electropneumatic control system is that the respective overshoot when moving to a new position is quantitatively determined and displayed to the operator. This enables the operator, by varying the adjustment of the throttle valve, to reliably find the setting resulting in a low or even the lowest overshoot value and thus maintaining a good transient response of the electropneumatic control system.

The varying of the setting of the bypass valve can be performed manually by an operator between the individual positionings or using automatic adjustment mechanisms, e.g., via a suitably controlled stepping motor. For automatic adjustment, it may be advisable to likewise provide the operator with a display of characteristic values for the respective settings of the bypass valve that were used to determine the different overshoot values when moving to new positions.

As the pneumatic characteristics of the control system for supplying air to and exhausting air from an actuator chamber may differ from one another, or as a plurality of boosters are used in the case of double-acting actuators, it may also be advantageous to determine a first group of overshoot values for movement in a first direction and a second group of overshoot values for movement of the actuator in a second direction counter to the first direction and to find for each group a setting of the bypass valve(s) with low overshoot based on the overshoot values respectively assigned.

During commissioning of electropneumatic control systems, particularly when using them to actuate control valves, frequently the two end positions of the pneumatic actuator are initially moved to in order to determine the operating range of the actuator. If the operating range is known, then it is possible to display in a particularly clear manner for the operator the overshoot values for assisting the operator in manually adjusting the bypass valve as percentages of the operating range.

An actuator position change performed automatically by the electropneumatic position controller has been found to be particularly advantageous, where the actuator is moved alternately back and forth between a first position in the lower half of the operating range, preferably between 10% and 40% of the operating range, and a second position in the upper half of the operating range, preferably between 60% and 90%. The overshoot values that are determined for moving to the first position then constitute a first group of overshoot values and the overshoot values for moving to the second position constitute a second group. In a practical trial, 30% of the operating range and 70% of the operating range have been found to be particularly advantageous presets for the first position and second position respectively. These positions have, in most cases, a sufficient distance from the respective end positions to determine the overshoot. In addition, the two positions are moved to with a sufficiently high positioning speed to determine the overshoot values.

The above mentioned object is also achieved by an electropneumatic position controller for use in an electropneumatic control system and operating in accordance with the method as described here and in the following, and comprising means for carrying out the method. The invention is preferably implemented in software or in a software/hardware combination. The invention is therefore, on the one hand, also a computer program having program code instructions that can be executed by a microcontroller of a position controller and, on the other hand, a storage medium containing such a computer program, i.e., a computer program product with program code means, and lastly an electropneumatic position controller into the memory of which such a computer program is or can be loaded as a way to implement the method and the embodiments thereof.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

An exemplary embodiment of the invention will now be explained in greater detail with reference to the accompanying drawings. Mutually corresponding items or elements are provided with the same reference characters in all the figures, in which.

DETAILED DESCRIPTION OF THE EXEMPLARY EMBODIMENTS

Figure 1:
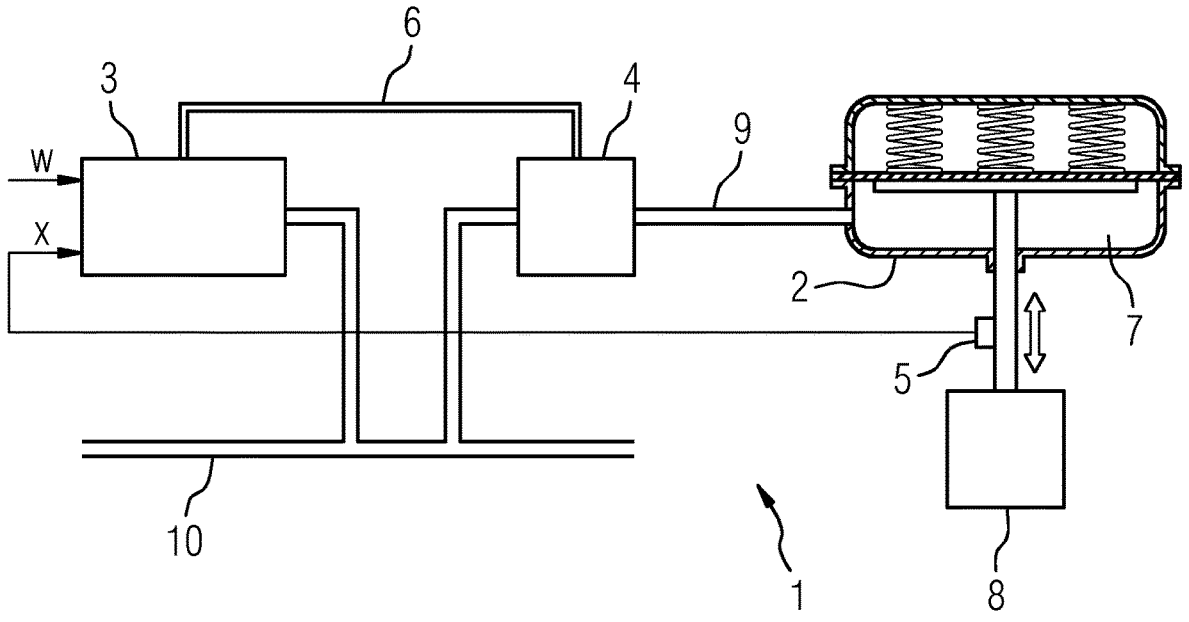
FIG. 1 shows an electropneumatic control system in accordance with the invention.

An electropneumatic control system 1 for a pneumatic actuator 2 comprises, as shown in FIG. 1, an electropneumatic position controller 3, a volume booster 4 and a position sensor 5 for acquiring an actual value x of the position of the pneumatic actuator 2. The position controller 3 is prescribed a setpoint value w for the actuator position e.g. by an automation device or control system (not shown in FIG. 1 for the sake of clarity). During controlled operation of the position controller 3, the setpoint value w is compared with the currently measured actual value x of the position and, depending on the deviation thus formed, a first pneumatic control signal 6 is generated to reduce the deviation. The exemplary embodiment shows a single-acting pneumatic actuator 2 having a comparatively large pressure chamber 7, and which is used to actuate a valve 8. However, in order to achieve short closing and opening times of the valve 8, the air flow rate that the position controller 3 provides with the first pneumatic control signal 6 is increased by a multiple via the volume booster 4. A second pneumatic control signal 9 that is generated by the booster 4 and applied to the pressure chamber 7 can therefore provide a sufficient air flow rate for fast movement of the actuator 2.

The booster 4 is a booster mounted externally to the position controller 3. Alternatively, the booster can self-evidently also be a device incorporated in the position controller 3. The position controller 3 and booster 4 are both directly connected to a compressed air supply line.

In order to reliably prevent vibration of the pneumatic actuator 2 during operation of the electropneumatic control system 1, an additional operating mode, is implemented in the position controller 3, which is used for the initialization thereof in a control system comprising a volume booster, as in the exemplary embodiment shown for using the volume booster 4. This initialization mode provides operator assistance, e.g., for manually adjusting a bypass valve with which the booster 4 is equipped for suppressing vibration and achieving a high positioning speed, as will be explained in greater detail below.

Figure 2:
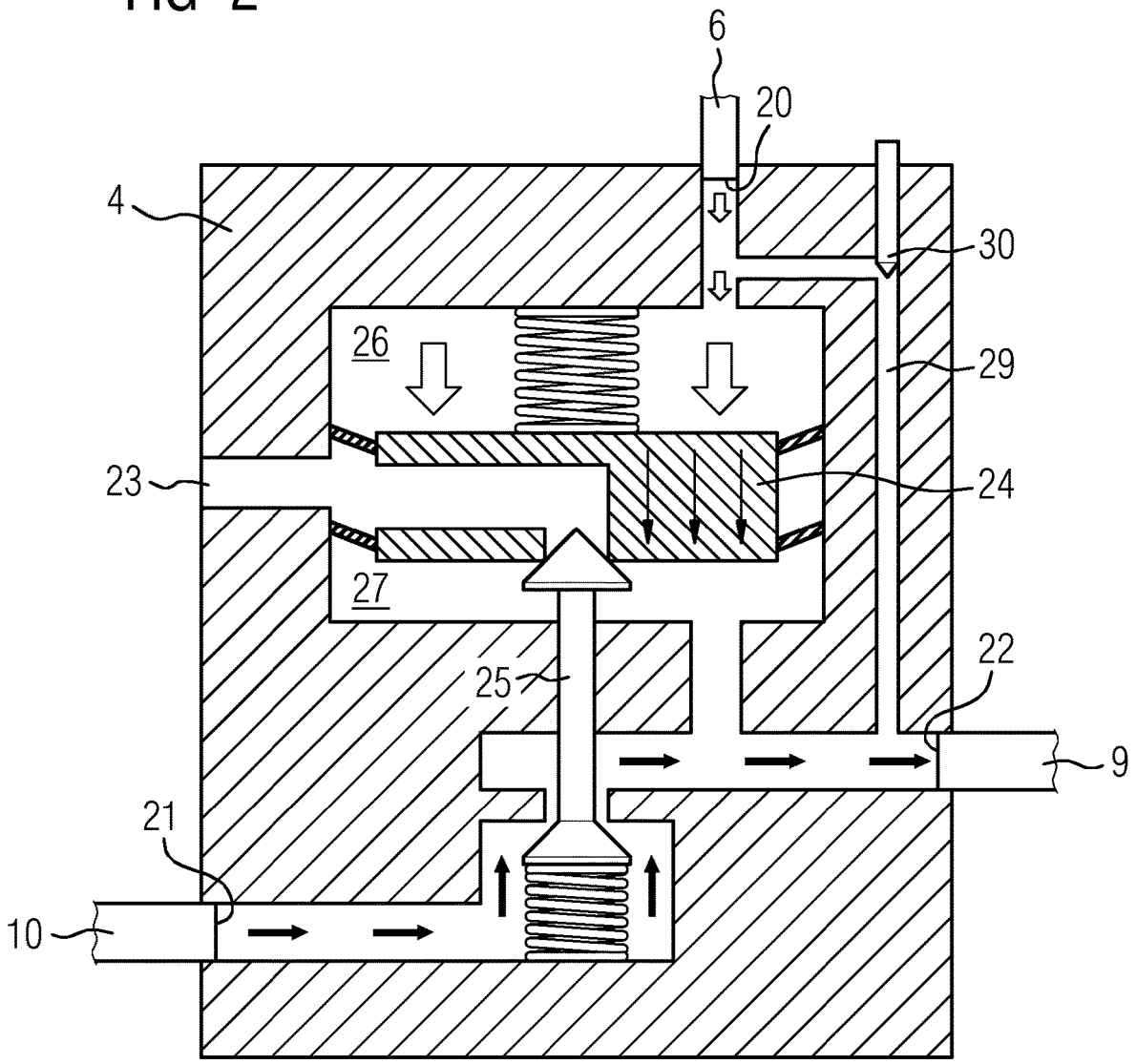
FIG. 2 shown a volume booster in a "supply air to actuator" position.
Figure 3:
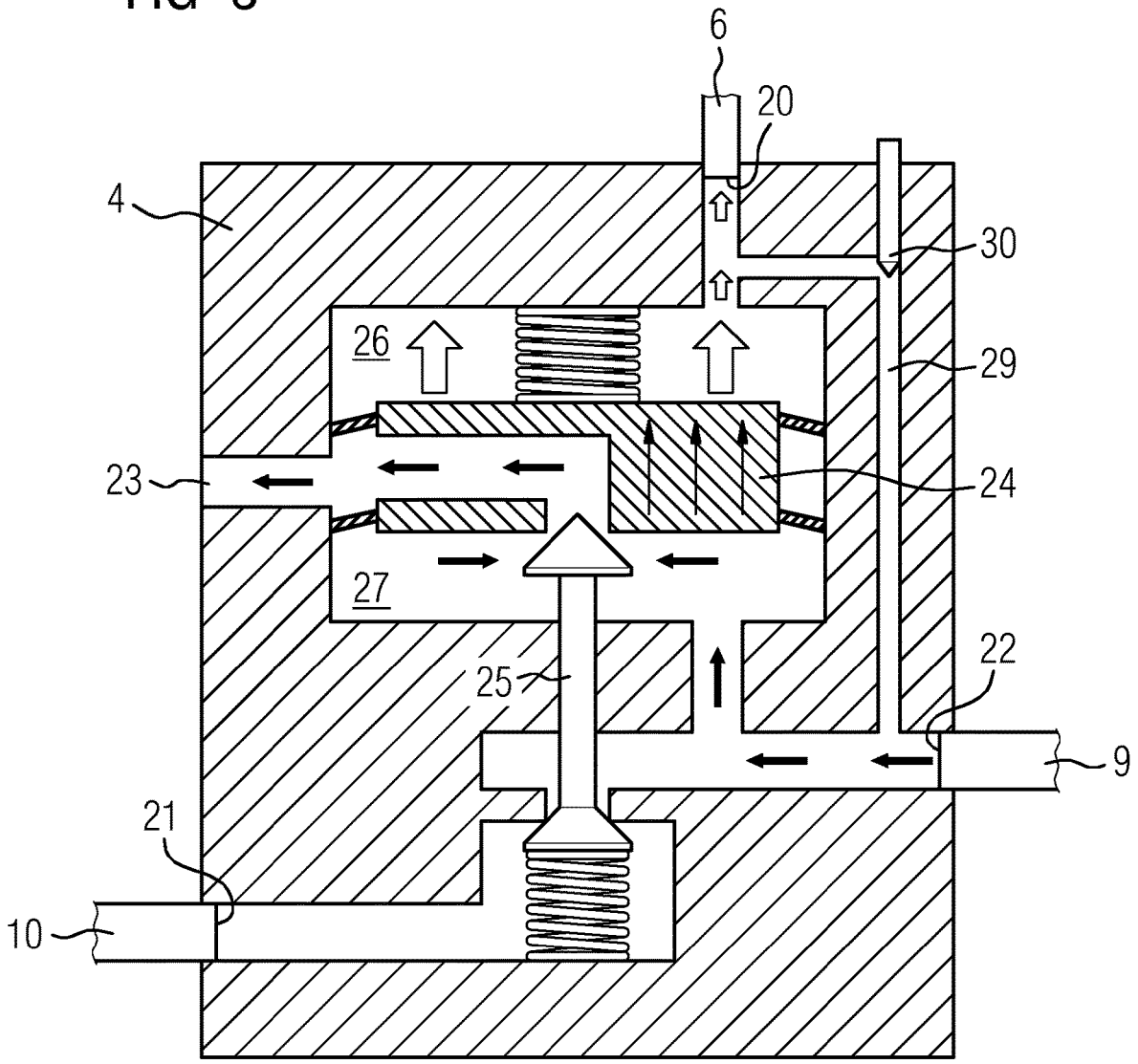
FIG. 3 shows the booster of FIG. 2 in an "exhaust air from actuator" position.

To provide a better understanding of the invention, the method of operation will first be described with the aid of an exemplary embodiment of the booster 4 as shown in FIGS. 2 and 3. The first pneumatic control signal 6 is supplied to a control input 20, the supply line 10 being for supplying compressed air to a compressed air input 21. The booster 4 supplies the second pneumatic control signal 9 at an output 22 that is connected to the chamber 7 (FIG. 1). Another output 23 leads to the outside and is used to vent the chamber 7. As soon as there is a pressure difference between the output 22 to the actuator 2 (FIG. 1) and the control input 20, a piston 24 moves to actuate a pusher 25 to either supply air to, or exhaust air from, the output 22.

To apply air to the actuator 2 (FIG. 1), an upper chamber 26 is supplied with air via the control input 20 by the position controller 3 (FIG. 1), as indicated in FIG. 2 by arrows marked above the piston 24. A pressure obtaining in a lower chamber 27 corresponds to the pressure in the chamber 7 (FIG. 1) of the actuator 2 (FIG. 1). The piston 24 in turn forces the pusher 25 downward and the air can flow from the input 21 to the output 22 and therefore to the actuator. As soon as the pressure at the output 22 and therefore the pressure in the lower chamber 27 matches the pressure of the upper chamber 26, the piston 24 moves upward and the pusher 25 shuts off the passage of air. This completes the air supply process.

To initiate an air exhaust process, the upper chamber 26 is vented via the control input 20, as indicated by the arrows above the piston 24 in FIG. 3. The pressure in the lower chamber 27 again corresponds to the chamber pressure of the actuator. The upper chamber 26 now has a lower pressure than the lower chamber 27. Consequently, the piston 24 is forced upward. However, the pusher 25 remains in its position and the air can flow from the actuator via the output 22 to the exhaust air output 23. As soon as the pressure at the output 22 has equalized with the pressure obtaining in the upper chamber 26, the piston 24 again moves downward and closes the air passage to terminate the air exhaust process.

As shown in FIGS. 2 and 3, the booster 4 possesses a bypass 29, i.e., a link between output 22 to the actuator and the control input 20. Disposed in the bypass 29 is a bypass valve 30 implemented as a needle valve with which the amount of air exchanged via the bypass 29 can be adjusted. The bypass valve 30 is adjusted using an initialization mode as part of the commissioning of the electropneumatic control system 1 (FIG. 1), i.e., after the position controller 3, booster 4, pneumatic actuator 2, valve 8 are installed with the required pipework and can be operated. The correct setting of the bypass valve 30 is important for subsequent problem-free operation of the control system 1.

In order to facilitate the setting of the bypass valve 30 for an operator and also make the setting reproducible, the position controller 3 (FIG. 1) has therefore been augmented by an additional operating mode.

Figure 4:
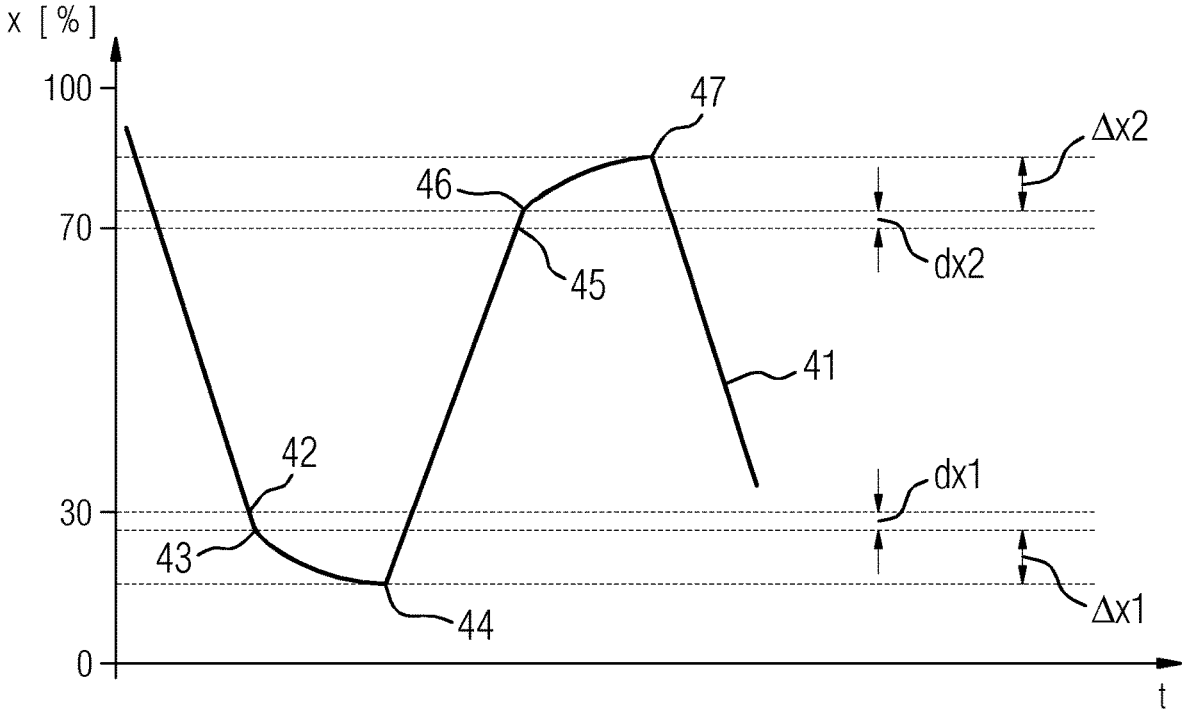
FIG. 4 shows a section of a graphical plot of a position response curve.

FIG. 4 shows a graphical plot of a section over time of a resulting position response curve 41 of the pneumatic actuator 2 (FIG. 1). The passage of time t is plotted on the abscissa and the measured actual value x of the position as a percentage as a function of an operating range between predefined end positions is plotted on the ordinate. Beginning from any starting position (the section of the response curve 41 shown by way of example begins at a position of approximately 90%), the pneumatic actuator is moved with maximum air flow rate in the direction of a new predefined or predefinable position that lies at approximately 30%. The operating mode for this process is established such that the movement occurs in an uncontrolled manner, i.e., the position controller applies air to or exhausts air from the output (or outputs if a plurality of boosters are connected) until the actual value of the actuator position fed back in the control system exceeds the predefined new position. Note that in order to simplify the phraseology in the present application, movement of the actuator beyond the new position is always termed "exceedance" regardless of the respective direction, i.e., even when, as in the case of point 42 of the response curve 41, a horizontal line marking the new position is "exceeded" downwards. In the event of the new position being exceeded, i.e., at point 42, the air flow rate is reduced to zero, i.e., the supplying/exhausting of air is stopped. The actuator initially still continues to move at an unchanged speed as far as a point 43 of the response curve 41. This is due to unavoidable internal time lags of the position controller. The distance involved is marked in FIG. 4 as a correction value dx1 that can be optionally taken into account for the overshoot measurement. A subsequent overshoot $\Delta x1$ is essentially influenced by the respective setting of the bypass valve 30. In the graph in FIG. 4, this overshoot $\Delta x1$ corresponds to the distance traveled between the point 43 and a point 44 at which the actuator has virtually come to a standstill. The overshoot value $\Delta x1$ constitutes a first value of a group of overshoot values that are measured for repeated movement of the actuator in this direction. Further movement processes of the same kind are no longer shown in FIG. 4 for purposes of clarity. The individual overshoot values are output on a display for the operator. The operator can vary the adjustment of the bypass valve between the individual movement processes and thus, by varying the setting of the bypass valve, to find a setting with a low overshoot value and select this setting for subsequent operation of the electropneumatic control system.

In the case of single-acting actuators, even repeated movement in the one direction described above would basically suffice for correct adjustment of the bypass valve. In the case of double-acting actuators, two boosters each acting in one direction are frequently installed. From point 44 of the response curve 41 onwards, an overshoot measurement is therefore also performed for movement in a second direction contrary to the first. For this purpose, the actuator is moved to a new position setpoint value which, in the exemplary illustrated embodiment, is at approximately 70% of the operating range. At a point 45 of the curve 41, the measured actual value exceeds the setpoint value, again maintains the same positioning speed up to a point 46 because of the internal time lag, and comes virtually to a standstill at a point 47. Similarly to the measurements performed in the first direction, a correction value dx2 and an overshoot value $\Delta x2$ are also measured for the second direction. Overshoot values Δx2 obtained for a plurality of movement processes in the second direction are displayed in each case, so that the operator can also adjust a bypass valve on a second booster to ensure a low overshoot.

Overshoot values of the first group that are measured with respect to the first direction, and overshoot values of the second group that are measured for the second direction contrary to the first direction are alternately output on the display. It would self-evidently also be possible to initially output only the overshoot values of the first group to assist the operator in manually adjusting a first bypass valve and then the overshoot values of the second group for adjusting a second bypass valve.

In each case, it is possible to change the setting of a bypass valve on a booster between the individual measurements while operating in initialization mode, to observe overshoot values obtained with the respective settings, and to respond thereto by suitably changing the setting of the bypass valve. In order to ensure problem-free control by the electropneumatic control system and obtain as short an adjustment time as possible in the event of setpoint value changes, the aim must be to select a bypass valve setting for minimal overshoot.

When adjustment of the bypass valve(s) is complete, initialization in another operating mode can then occur to determine new control parameters for the position controller, because a changed setting of the bypass valve(s) may also cause the dynamics of the electropneumatic control system to change.

Figure 5:
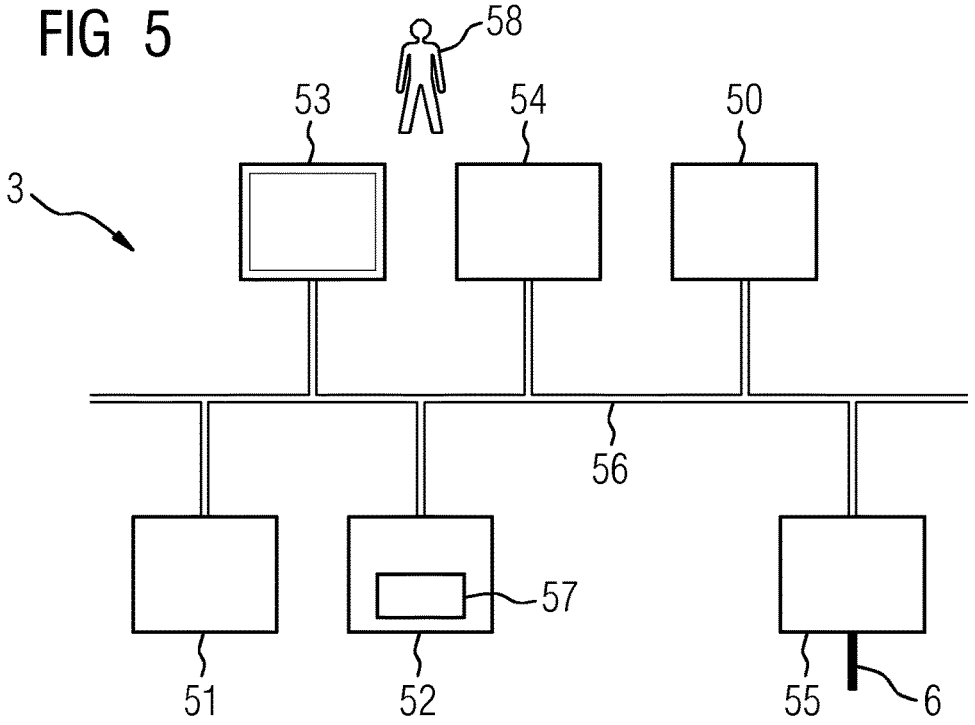
FIG. 5 shows a block diagram of an electropneumatic position controller in accordance with the invention.

FIG. 5 shows a structure of an electropneumatic position controller 3 comprising a microcontroller 50 having a data memory 51 and program memory 52, and a display 53 and an input device 54 for operator control. A valve group 55 is used for program-controlled generation of the first pneumatic control signal 6. The components 50 . . . 55 mentioned are communicatively interconnected via an internal bus system 56. Loaded in the program memory 52 is, among other things, a computer program 57 that is used to implement the described operating mode that provides assistance for bypass valve adjustment. The computer program 57 can also be retroactively loaded into a conventional position controller 3 as part of a firmware update, for example.

Figure 6:
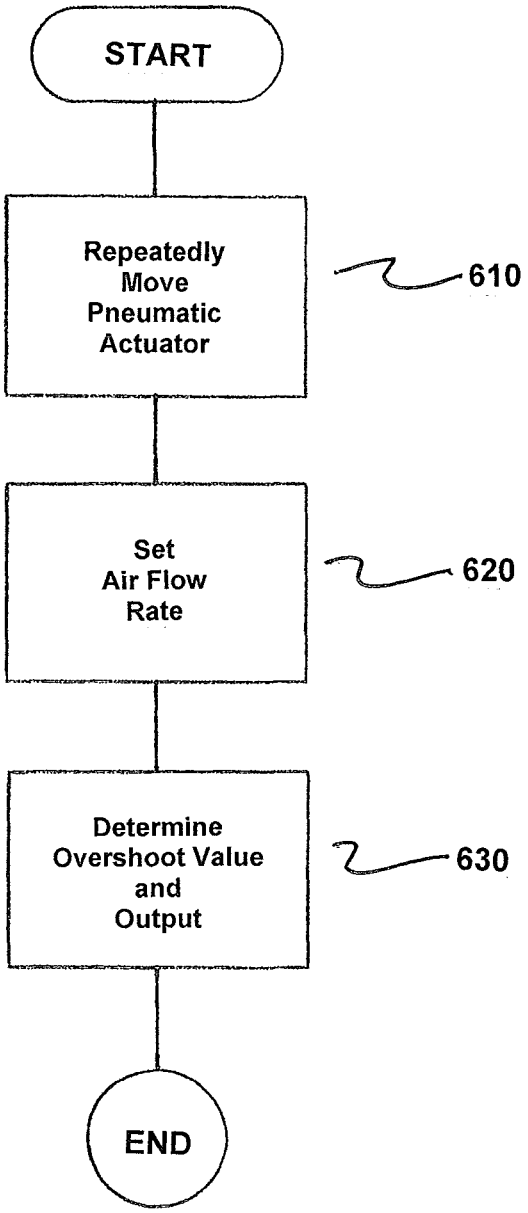
FIG. 6 is a flowchart of the method in accordance with the invention.

FIG. 6 is a flowchart of the method for operating an electropneumatic control system for a pneumatic actuator 2 comprising an electropneumatic position controller 3 for generating a first pneumatic control signal 6 as a function of a predefined or predefinable position setpoint value w and a measured actual value x of the position of the pneumatic actuator 2 and having at least one volume booster 4 for increasing an air flow rate of the electropneumatic position controller 3 and for generating, as a function of the first pneumatic control signal 6, a second pneumatic control signal 9 which is applied to the pneumatic actuator 2, where an adjustable bypass valve 30 is disposed in a connection 29 between the first and the second pneumatic control signals 6; 9. The method comprises moving the pneumatic actuator 2 repeatedly by the electropneumatic position controller 3 with maximum air flow rate in a first direction in each different setting of the bypass valve 30 until a predefined or predefinable position is reached, as indicated in step 610.

Next, the air flow rate is set to zero each time the position is overshot, as indicated in step 620.

Next, an overshoot value Δx1 of the pneumatic actuator 2 is determined and output on a display 53, as indicated in step 630.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. An electropneumatic control system for a pneumatic actuator, comprising:

an electropneumatic position controller having a microprocessor, said electropneumatic position controller generating a first pneumatic control signal in accordance with a predefined or predefinable position setpoint value and a measured actual value of the position of the pneumatic actuator; and at least one volume booster for increasing an air flow rate of the electropneumatic position controller and for generating, as a function of the first pneumatic control signal, a second pneumatic control signal which is supplied to the pneumatic actuator, an adjustable bypass valve being disposed in a connection between the first and second pneumatic control signals;

wherein the electropneumatic position controller is configured to repeatedly move the pneumatic actuator automatically during an initialization mode of the electropneumatic position controller by applying air to or by exhausting air from at least one output until the measured actual value of the position of the pneumatic actuator fed back to the electropneumatic control system exceeds a predefined or predefinable new position setpoint value, maximum air flow rate in a first direction in each different setting of the adjustable bypass valve being automatically applied until the predefined or predefinable new position setpoint value is reached, to set the air flow rate to zero each time the predefined or predefinable new position setpoint value is overshot, and configured to determine an overshoot value of the pneumatic actuator for each respective setting of the adjustable bypass valve and output said determined overshoot value on a display; and wherein the respective setting of the adjustable bypass valve is automatically adjusted to reduce the overshoot when the overshoot is detected and output.

2. The electropneumatic control system as claimed in claim 1, wherein the electropneumatic position controller is further configured to move the pneumatic actuator repeatedly with maximum air flow rate in a second direction counter to the first direction in each different setting of the bypass valve until the predefined or predefinable new position setpoint value is reached, to set the air flow rate to zero each time the predefined or predefinable new position setpoint value is reached, and to determine the overshoot value of the pneumatic actuator and output said determined overshoot value on the display.

3. The electropneumatic control system as claimed in claim 2, wherein the electropneumatic position controller is configured to display overshoot values as percentages as a function of an operating range of the pneumatic actuator between predetermined end positions.

4. The electropneumatic control system as claimed in claim 3, wherein a first position is predefined in a range of between 10% and 40% of the operating range and a second position is predefined in a range of between 60% and 90% of the operating range; and wherein the electropneumatic position controller is configured to move the pneumatic actuator alternately from the first to the second position and to move the pneumatic actuator alternately from the second to the first position.

5. The electropneumatic control system as claimed in claim 4, wherein the first position is predefined at 30% and the second position at 70% of the operating range.

6. An electropneumatic position controller for an electropneumatic control system, comprising:

a microprocessor; and memory;

wherein the microprocessor is configured to generate a first pneumatic control signal as a function of a predefined or predefinable position setpoint value and a measured actual value of a position of a pneumatic actuator;

wherein at least one volume booster is disposable downstream of the electropneumatic position controller to increase an air flow rate thereof; and wherein in order to adjust a bypass valve of the at least one volume booster, the electropneumatic position controller is configured to repeatedly move the pneumatic actuator automatically during an initialization mode of the electropneumatic position controller by applying air to or by exhausting air from at least one output until the measured actual value of the position of the pneumatic actuator fed back to the electropneumatic control system exceeds a predefined or predefinable new position setpoint value, maximum air flow rate in a first direction in each different setting of the adjustable bypass valve being automatically applied until the predefined or predefinable new position setpoint value is reached, to set the air flow rate to zero each time the predefined or predefinable position new setpoint value is overshot, and configured to determine an overshoot value of the pneumatic actuator for each respective setting of the adjustable bypass valve and output said overshoot value on a display; and wherein the respective setting of the adjustable bypass valve is automatically adjusted to reduce the overshoot when the overshoot is detected and output.

7. A method for operating an electropneumatic control system for a pneumatic actuator comprising an electropneumatic position controller having a microprocessor, said electropneumatic position controller generating a first pneumatic control signal as a function of a predefined or predefinable position setpoint value and a measured actual value of the position of the pneumatic actuator and comprising at least one volume booster for increasing an air flow rate of the electropneumatic position controller and for generating, as a function of the first pneumatic control signal, a second pneumatic control signal which is applied to the pneumatic actuator, an adjustable bypass valve being disposed in a connection between the first and the second pneumatic control signals, the method comprising:

moving the pneumatic actuator repeatedly via the electropneumatic position controller automatically during an initialization mode of the electropneumatic position controller by applying air to or by exhausting air from at least one output until the measured actual value of the position of the pneumatic actuator fed back to the electropneumatic control system exceeds a predefined or predefinable new position setpoint value, maximum air flow rate in a first direction in each different setting of the adjustable bypass valve being automatically applied until the predefined or predefinable new position setpoint value is reached;

setting the air flow rate to zero each time the predefined or predefinable new position setpoint value is overshot;

determining an overshoot value of the pneumatic actuator for each respective setting of the adjustable bypass value and outputting said determined overshoot value on a display; and adjusting the respective setting of the adjustable bypass valve automatically to reduce the overshoot each time an overshoot is detected and output.

8. A non-transitory computer program product encoded with a computer program executed by a microcontroller having a microprocessor, which causes operation of an electropneumatic control system for a pneumatic actuator having at least one volume booster with an adjustable bypass valve between a control input and an output of the volume booster, the computer program comprising:

program code for moving the pneumatic actuator repeatedly via the electropneumatic position controller automatically during an initialization mode of the electropneumatic position controller by applying air to or by exhausting air from at least one output until the measured actual value of the position of the pneumatic actuator fed back to the electropneumatic control system exceeds a predefined or predefinable new position setpoint value, maximum air flow rate in a first direction in each different setting of the adjustable bypass valve being automatically applied until the predefined or predefinable new position setpoint value is reached;

program code for setting the air flow rate to zero each time the predefined or predefinable new position setpoint value is overshot;

program code for determining an overshoot value of the pneumatic actuator for each respective setting of the adjustable bypass value and outputting said determined overshoot value on a display; and program code for adjusting the respective setting of the adjustable bypass valve automatically to reduce the overshoot each time an overshoot is detected and output.

9. The non-transitory computer program product as claimed in claim 8, wherein the non-transitory computer program product comprises a data carrier or storage medium.

* * * * *